US007128228B2

(12) United States Patent
Collins

(10) Patent No.: US 7,128,228 B2
(45) Date of Patent: Oct. 31, 2006

(54) CONTAINER CLOSURE

(75) Inventor: Peter Anthony Collins, Holmbury St. Mary (GB)

(73) Assignee: Advanced Biotechnologies Limited (GB)

( * ) Notice: Subject to any disclaimer, the term of this patent is extended or adjusted under 35 U.S.C. 154(b) by 2 days.

(21) Appl. No.: 10/297,498

(22) PCT Filed: Jun. 6, 2001

(86) PCT No.: PCT/GB01/02484

§ 371 (c)(1),
(2), (4) Date: Aug. 18, 2003

(87) PCT Pub. No.: WO01/94019

PCT Pub. Date: Dec. 13, 2001

(65) Prior Publication Data

US 2004/0026353 A1 Feb. 12, 2004

(30) Foreign Application Priority Data

Jun. 6, 2000 (GB) ..... 0013690.3

(51) Int. Cl.
*B65D 39/00* (2006.01)

(52) U.S. Cl. ..... 215/247; 215/297; 220/787

(58) Field of Classification Search ..... 215/247, 215/355–364, DIG. 3, 249, 296–300, 320; 604/408, 415; 222/563, 554; 422/102–104; 220/800–804, 787, 789
See application file for complete search history.

(56) References Cited

U.S. PATENT DOCUMENTS 3,653,528 A * 4/1972 Wimmer ..... 215/247
3,974,930 A * 8/1976 Gizard et al. ..... 215/247
4,515,752 A 5/1985 Miramanda ..... 422/99
5,060,812 A 10/1991 Ogle ..... 215/247
5,114,408 A * 5/1992 Fleischhaker et al. . 604/167.04
5,199,948 A * 4/1993 McPhee ..... 604/86
5,202,093 A 4/1993 Cloyd ..... 422/102
5,211,634 A * 5/1993 Vaillancourt ..... 604/167.02
5,273,546 A * 12/1993 McLaughlin et al. .. 604/167.04
5,403,293 A * 4/1995 Grabenkort ..... 604/256
5,433,330 A * 7/1995 Yatsko et al. ..... 215/247
5,531,810 A * 7/1996 Fullemann ..... 96/105
5,983,770 A * 11/1999 Helgren et al. ..... 83/868
6,186,997 B1 * 2/2001 Gabbard et al. ..... 604/408
6,702,434 B1 * 3/2004 Barinaga et al. ..... 347/85

FOREIGN PATENT DOCUMENTS

WO WO 83/01912 6/1983

* cited by examiner

*Primary Examiner*—Lien M. Ngo
(74) *Attorney, Agent, or Firm*—Wood, Herron & Evans, LLP

(57) ABSTRACT

A closure means adapted to fit into the neck or mouth of a container, said closure means comprising a plug of resilient material said plug incorporating a slit which extends through the body of the plug characterized that, in a resting configuration and prior to insertion of the closure means into a container, the breadth of the slit is non-uniform along the length of the slit.

37 Claims, 4 Drawing Sheets

CONTAINER CLOSURE

FIELD OF THE INVENTION

The present invention relates to closure means for tubes, multi-well plates or other containers. It is particularly applicable, but in no way limited, to multi-sipping caps and tubes or containers incorporating multi-sipping caps.

BACKGROUND TO THE INVENTION

In life science chemistry, for example, there are a wide number of applications that involve preparation, storage and analysis of a large number of samples. Such applications include drug discovery, including combinatorial chemistry, and Polymerase Chain Reaction (PCR) experiments. In these applications reaction tubes, vials or the like are often filled or part filled with reagents and the tubes sealed prior to further processing. In addition, multi-well plates, consisting of an array of tubes, are now used extensively in molecular biology laboratories and elsewhere.

A number of ways for sealing such tubes have been developed over the years. For example, a foil or plastic film may be applied across the entire upper surface of a plate of tubes. Thus heat sealable aluminium foils or adhesive plastic films are commercially available. Once applied, these films provide an efficient, gas and liquid-tight seal but are tiresome to apply and remove. Access to each well can only be obtained by piercing the film or by peeling off the film by hand or with a foil stripper. Consequently, this type of seal is not reusable, and is not suitable for robotic application or removal. Furthermore, the seal does not reform automatically if a sample is withdrawn with a syringe needle, pipette tip or cannula for example.

Alternatively, a seal may be achieved by placing a relatively heavy, flexible rubber mat over the entire surface of the plate. The weight of the mat and any plate(s) stacked on top of the mat keep the seal in place. It is important that the mat does not slide over the top of the plate in order to avoid cross-contamination. In the case of 96 well plates, this is achieved by having 96 raised dimples or "pimples" an the surface of the mat in an array that matches exactly the array of wells. Each dimple is sized and shaped to sit firmly into a well. Once in place, no lateral movement of the mat is possible because the perimeter of each dimple fits snugly within its respective well. However, such mats do not produce a complete, fluid-tight seal and some evaporation can still take place.

If a more fluid-tight seal is required then a cap can be applied to each tube. Strips of caps are available for multi-well plate, examples of which are sold by Advanced Biotechnologies Limited under Catalogue No AB0784. Such caps can include a piercable or septum region usually in the centre of the cap, which is easily piercable with a needle. This allows material to be withdrawn from or added to the tube or well without, supposedly, damaging the cap. However, each time a needle is inserted through the cap it causes some damage to the septum region as it punctures the surface. A syringe needle, however small, tends to act like a cutter, removing a fragment of cap each time it penetrates. Eventually, after a number of such penetrations, the damaged area no longer forms a fluid-tight seal.

Sealing devices for sealing tubes are also known from WO 83/01912 (Labsystems OY) which incorporate a slit or a channel designed to allow the passage of a pipette or capillary tube. The slits in these sealing devices are formed from two straightsided components that mate together. To be effective, the channel must remain tightly closed at all times, even when a pipette is inserted through it. However, when the pipette is withdrawn the sealing device must not have a tendency to withdraw from the tube along with the pipette. These two requirements tend to be mutually incompatible. On the one hand, a firm, liquid-tight seal is required when the sealing device is in place and the channel is unpenetrated. This requires that the opposing walls of the channel must be forced very firmly against each other. These same forces also tend to grip any pipette, needle or capillary tube that is introduced into the channel very firmly. This firm grip on the pipette etc. tends to cause the sealing device to work its way up and out of the tube as the pipette is withdrawn. This problem is compounded if multiple samples (multi-sipping) are required.

It is an object of the present invention to overcome or at least mitigate some or all of the problems outlined above.

SUMMARY OF THE INVENTION

According to a first aspect of the present invention there is provided a closure means adapted to fit into the neck or mouth of a container, said closure means comprising a plug of resilient material said plug incorporating a slit which extends through the body of the plug characterised in that, in a resting configuration and prior to insertion of the closure means into a container, the breadth of the slit is non-uniform along the length of the slit. By providing a slit of non-uniform breadth the force exerted on a pipette or needle inserted through the closure can be controlled whilst still retaining a good fluid tight seal under normal conditions.

Preferably the slit incorporates a constriction running substantially the width of the slit. This arrangement allows for a pipette or other instrument to penetrate the slit at any point across its width.

In a preferred embodiment the constriction is formed by the opposing side walls of the slit substantially touching across substantially the whole width of the slit.

In certain embodiments the internal breadth of the slit is non-uniform and incorporates a constriction substantially mid-way along its length. This constriction serves to improve the seal both under normal use conditions and when a needle penetrates the seal.

Preferably an outermost in use surface of the plug, in other words the top of the plug in the orientation in which the plug is inserted into a container, incorporates a funnel-shaped depression that serves to direct a needle or other sampling device towards the entrance to the slit. An operator or robotic sampler does not have to rely on putting the tip of a pipette/needle accurately into the slit each time a sample is taken.

Preferably the funnel-shaped depression is substantially conical-shaped and most preferably the depression is formed in the shape of a right circular cone.

A closure means according to any preceding claim wherein the plug of resilient material is formed from a lower cylindrical portion adapted to be a tight sliding fit in the neck or mouth of a container and an upper cylindrical portion having a greater diameter than the lower cylindrical portion and adapted to overlie the neck or mouth of the container. This arrangement prevents the closure from being forced or drawn into the container body or pass down into the bore of a tube or vial.

Preferably the width of the slit also varies across the length of the plug.

Preferably the width of the slit is narrower at the outermost in use surface of the plug than at the lowermost in use surface.

In a preferred embodiment the slit extends substantially entirely across the diameter of the plug at the bottom of the lower cylindrical portion.

In a further preferred embodiment the closure means further comprises a sealing bead extending substantially entirely around the circumference of the resilient plug.

Preferably the sealing bead is so sized, shaped and configured as to fit into a corresponding indentation around the inside perimeter of the neck or mouth of a container. This provides for a positive or snap fit engagement of the closure means into a container and further reduces the tendency of the closure means to separate from the container when repeated samples are withdrawn.

Preferably the bottom perimeter of a lower cylindrical portion is radiused or chamfered. This makes it easier to insert the closure means into a container when it is a tight sliding fit.

In an alternative embodiment the plug of resilient material is set into a closure body, said closure body being adapted to fit into the neck or mouth of a container. This arrangement is particularly appropriate when the container has a wide mouth.

According to a second aspect of the invention there is provided a closure means adapted to fit into the neck or mouth of a container, said closure means comprising a plug of resilient material said plug incorporating a slit which extends through the body of the plug characterised in that the width of the slit as it extends across the plug is non-uniform along the length of the slit.

Preferably the slit incorporates a constriction running substantially the width of the slit.

Preferably the constriction is formed by the opposing side walls of the slit substantially touching across substantially the whole width of the slit.

Preferably wherein an outermost in use surface of the plug incorporates a funnel-shaped depression that serves to direct a needle or other sampling device towards the entrance to the slit.

Preferably the funnel-shaped depression is substantially conical-shaped, and most preferably the depression is formed in the shape of a right circular cone.

Preferably the plug of resilient material is formed from a lower cylindrical portion adapted to be a tight sliding fit in the neck or mouth of a container and an upper cylindrical portion having a greater diameter than the lower cylindrical portion and adapted to overlie the neck or mouth of the container.

Preferably the width of the slit is narrower at the outermost in use surface of the plug than at the lowermost in use surface.

Preferably the slit extends substantially entirely across the diameter of the plug at the bottom of the lower cylindrical portion.

In a further preferred embodiment the closure means further comprises a sealing bead extending substantially entirely around the circumference of the resilient plug.

Preferably the sealing bead is so sized, shaped and configured as to fit into a corresponding indentation around the inside perimeter of the neck or mouth of a container. This provides for a positive or snap fit engagement of the closure means into a container and further reduces the tendency of the closure means to separate from the container when repeated samples are withdrawn.

Preferably the bottom perimeter of a lower cylindrical portion is radiused or chamfered.

In an alternative embodiment the plug of resilient material is set into a closure body, said closure body being adapted to fit into the neck or mouth of a container.

The present invention also extends to include a container incorporating a closure means as claimed herein.

BRIEF DESCRIPTION OF THE DRAWINGS

The present invention will now be described by way of example only with reference to the accompanying drawings in which.

DESCRIPTION OF THE PREFERRED EMBODIMENTS

The invention will now be described by way of example only. These examples represent the best ways known to the applicant of putting the invention into practice, but they are not the only ways in which this can be achieved.

Figure 1A:
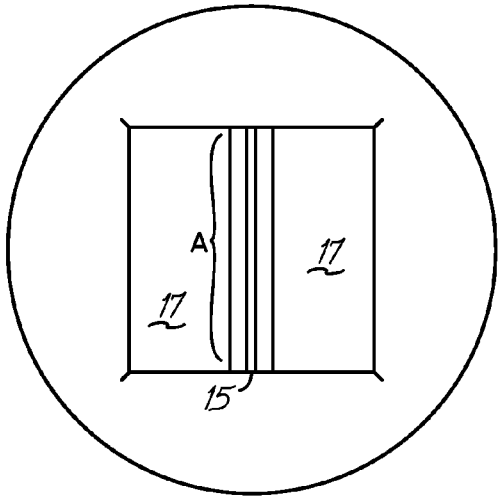
FIGS. 1A to 1C illustrate top plan, side cross-sectional and bottom views respectively of a first embodiment of the present invention.
Figure 1B:
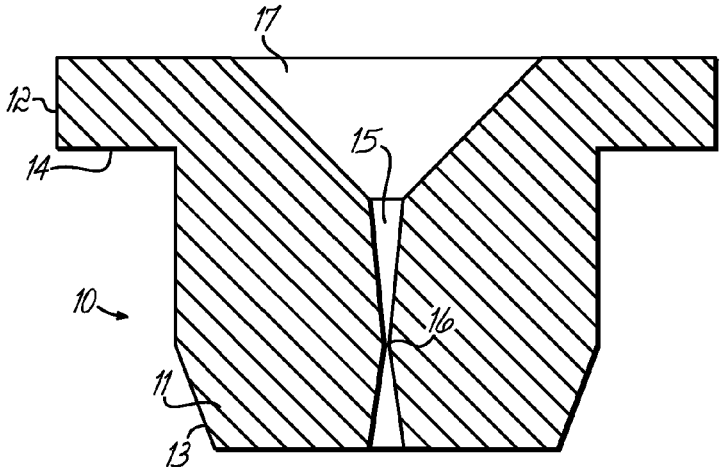

Referring to FIG. 1, this illustrates a closure means 10 formed from a plug of resilient material and consisting of a lower cylindrical portion 11 and an upper cylindrical portion 12. The lower cylindrical portion has a diameter slightly larger than that of the tube in which it is intended to fit. The lower end portion 13 or bottom perimeter of the lower cylindrical portion 11 is slightly chamfered to ensure an easy fit into the tube. The upper cylindrical portion 12 has a diameter that is larger than that of the tube such that it overlies the tube wall (not shown) when the closure means is pushed fully home. In use, the tube wall abuts shoulder 14.

In the present example the resilient plug is of unitary construction and is formed from an elastomeric material (see below). A unitary form of construction is not necessary however and the closure means could be formed from a number of components. For example, a resilient plug of this or similar design could form the central component of a stopper or cap adapted to fit a specific container. In this case a resilient plug as herein described could be mounted into a closure body that in turn would be adapted to fit into the neck or mouth of a container.

The stopper or cap should be a tight fit in the mouth of the container or there should be some mechanical means for holding the stopper in place. It follows therefore that the plug of resilient material need not be in the form of a straight-sided cylinder where the plug itself is not adapted to contact the container wall or container mouth directly. However, for closing small vials it is more convenient to use the one-piece construction illustrated.

A key feature of this closure means is a slit 15 that extends through the body of the closure. In the upper cylindrical portion the width of the slit "A" is significantly less than the diameter of that portion. At the lower end of the lower cylindrical portion the slit extends substantially entirely across the whole portion such that the closure means in that region is formed form two semi-circular flaps that meet along their respective diameters.

As a result of this navel shape and configuration of slit, it is easier to move a pipette or the like from side to side in the container. The pipette can therefore be angled towards the bottom corners of the container more easily than in prior art closures of this type.

Whilst the width of the slit varies along its length, the breadth of the slit can be constant or can also vary. In this embodiment the walls of the slit are not parallel. Rather, the slit narrows towards its mid point 16 such that, prior to insertion into a tube, the walls of the slit in that region are substantially touching. This arrangement provides an improved fluid-fight seal both during normal use and when a needle is inserted through the slit A generally funnel-shaped depression or indention 17 is formed in the top of the closure means with the slit being aligned with the bottom of the depression. The depression serves to guide a needle to the entrance to the narrow slit. Thus, providing a needle is placed somewhere within the area of the depression 17, downward pressure will ultimately cause the needle to enter the slit and thus to penetrate the closure. The shape of the depression is therefore not critical and any shape that has the effect of guiding a needle downwards towards the slit entrance will suffice. A preferred shape for this depression is conical and, for a closure means that is symmetrical about a central longitudinal axis, a circular conical shape is preferred. That is to say, the depression is formed substantially in the shape of a right circular cone.

Figure 1C:
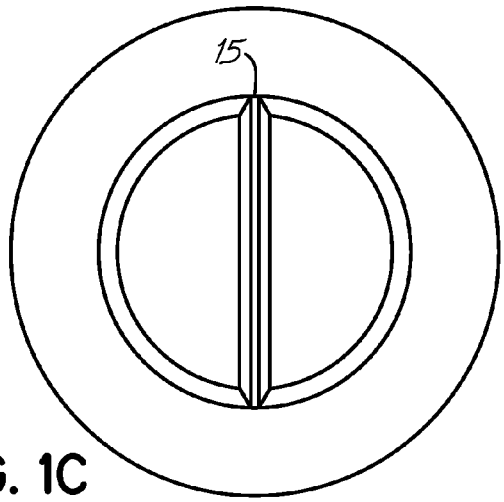

In terms of the physical size and shape of the slit 15, the dimensions of the width and the breadth of the slit are important. The term 'width' in this context relates to the degree to which the slit extends across the diameter of the plug at various points along the longitudinal axis of the plug ie along the length of the plug. Preferably, although it is not essential, the slit is located on a diameter line passing, of necessity, through the central axis of the plug, as shown in FIG. 1C. The slit does not extend across the full width of the plug at all points along the plug body. If it did then the plug would be sectioned into two separate parts.

The slit is formed from two opposing side walls which are spaced apart for some portion of the slit. The term 'breadth' in this context therefore refers to the separation, if any, between these opposing side walls. The breadth will vary depending on whether the closure means is compressed into a container or uncompressed ie not inserted into a container. This latter position is referred to as the nesting configuration position and is generally the position that is illustrated in the figures.

The slit extends substantially through the whole depth of the plug in certain regions. That is to say, with the closure means inserted into a container there is a passageway, formed by the slit, such that a pipette, needle or the like can be forced through the slit from outside the container to access the container contents. The length or depth of the slit will vary because of the shape of the indentation in the top of the plug. This indentation directs a pipette/needle to the outer entrance of the slit.

Figure 2A:
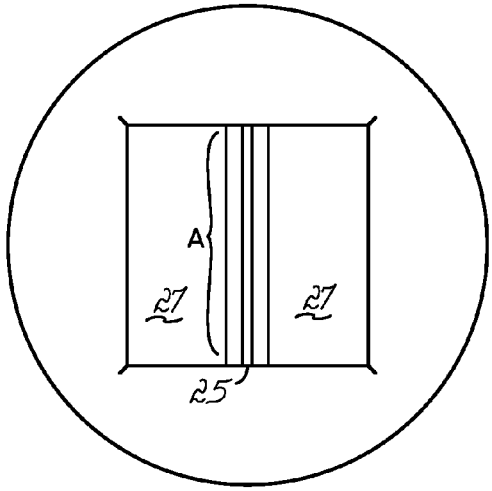
FIGS. 2A to 2C illustrate top plan, side cross-sectional and bottom views respectively of a second embodiment of the present invention.
Figure 2B:
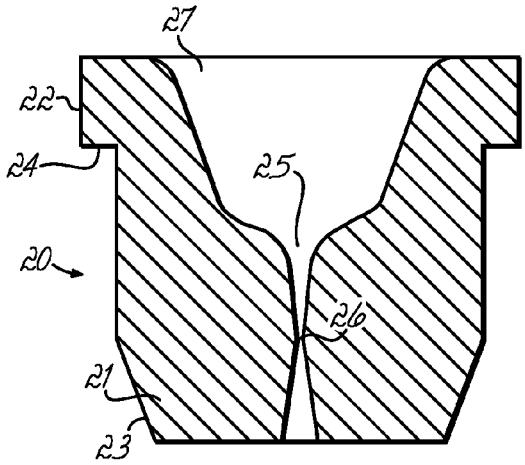
Figure 2C:
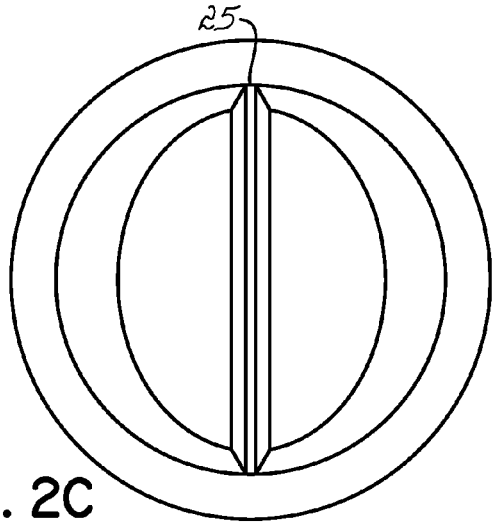
Figure 3:
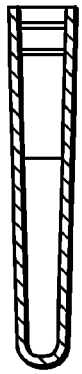
FIGS. 3 and 4 illustrate an example of a tube and a tube closure of the present invention in their actual size in one embodiment.
Figure 4:
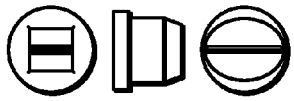

A further embodiment is illustrated in FIG. 2 where a common numbering system has been used.

It is important that the slit region at least is made from a resilient material. In this example the closure means is constructed entirely from a resilient plastics material such as silicone or other organic rubber compounds. Whilst it is usually advantageous to do so, the closure means need not be made from the same material throughout. This might be advantageous when larger closures are required for bottles or kegs. In this case the upper cylindrical portion may be made from a more rigid material such as polyethylene, polypropylene or PTFE.

In use, the closure means is inserted into a tube and pushed home until the shoulder 14, 24 engages the top of the tube wall. This causes the slit to close substantially completely along its entire length and to form a substantially fluid-tight seal. When it is required to sample or add to the tube contents a needle or the like is inserted into the depression 17, 27, through slit 15, 25 and thus into the tube. Samples can then be taken or added. The resilient material from which the slit region is constructed forms tightly around the needle. Where a substantially circular pipette tip, needle or the like is forced through the slit into the container beneath, there are formed two small apertures, one on either side of the pipette tip along the longitudinal axis of the slit (not shown). These apertures have an important function. They provide an air passage around the pipette such that accurate pipetting can take place by allowing the air pressure inside and outside the container to equalize. They also reduce the tendency for aerosol dispersion as the pipette is withdrawn from the closure.

Figure 5:
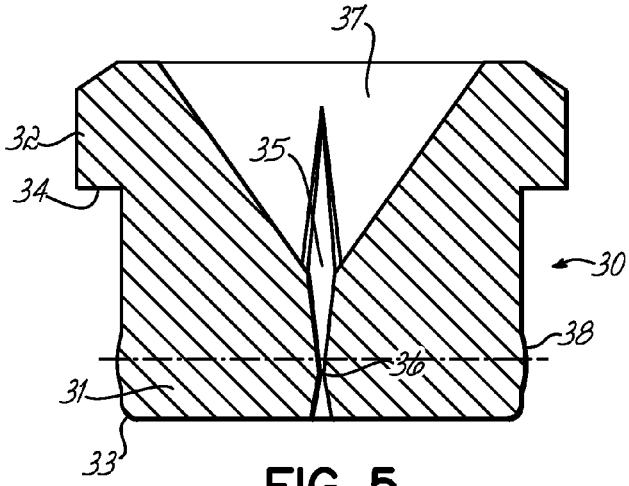
FIG. 5 illustrates a side cross-sectional view of a third embodiment of the present invention.
Figure 6:
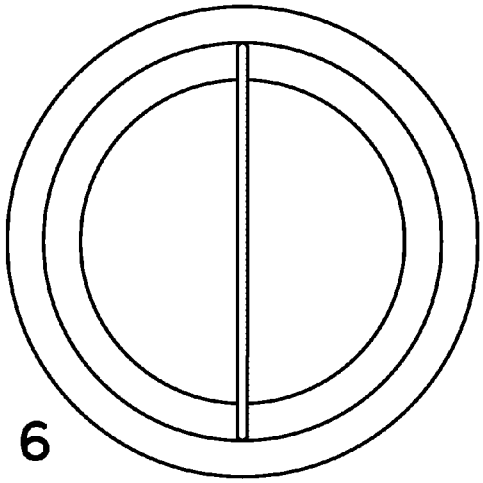
FIGS. 6 and 7 illustrate bottom plan and top plan views of the tube closure shown in FIG. 5.
Figure 7:
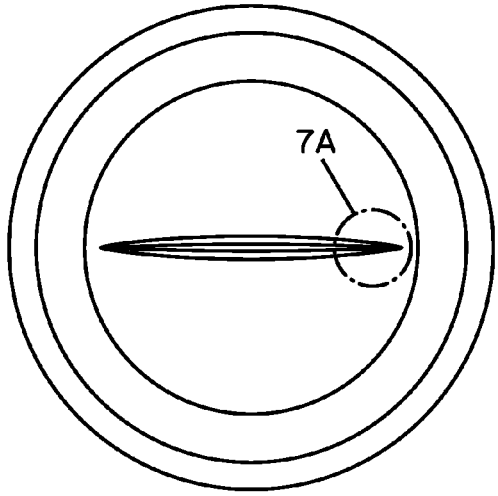
Figure 7A:
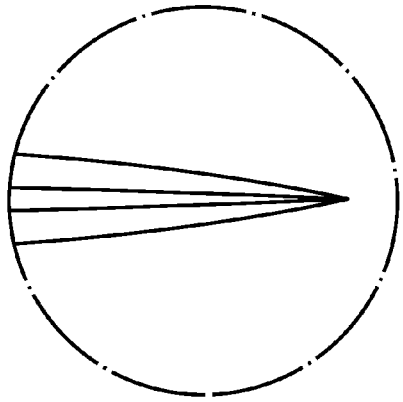
FIG. 7A is an enlarged view of the encircled area 7A in FIG. 7.
Figure 8:
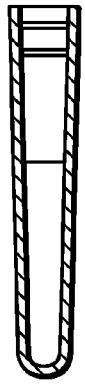
FIGS. 8 and 9 illustrate an example of a tube and tube closure in their actual size according to one embodiment
Figure 9:
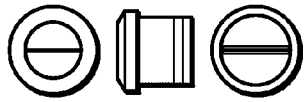

A further embodiment is illustrated in FIGS. 5 to 9 inclusive FIG. 5 illustrates a cross-sectional view of a further closure means prior to insertion into a tube or container. Components are numbered in a corresponding manner to those illustrated in FIGS. 1B and 2B. In this case an upper cylindrical portion 32 is connected to a lower cylindrical portion 31 that has a slightly smaller diameter. The diameter of the lower portion 31 is such that it forms a tight sliding fit with a corresponding tube or other container. A sealing bead, in the form of a ridge, extends substantially entirely around the circumference of the closure means. The function of this sealing bead is to increase the friction between the closure means and the mouth of the container in which it is positioned. Increasing this friction is important because with multiple sampling there is a tendency for the closure to work its way out of place and eventually out of the mouth of the container.

Advantageously, this sealing bead fits into a corresponding indentation around the inside perimeter of the vial or container in which the closure means is designed to fit. This gives a type of snap-fit arrangement of the plug within a tube. When the plug is made of relatively soft silicone rubber an operator cannot, however, always detect a snap-fit feel. In any event, the incorporation of a feature on the outside side edge of the closure means that is adapted to positively engage with a corresponding feature on the mouth wall of the container is novel, particularly when applied to this type of closure. This feature means that there is increased frictional resistance preventing inadvertent removal or withdrawal of the plug during multiple sipping.

The shape of the indentation in this embodiment is substantially circular conical. That is to say, the mouth of the closure means, at the uppermost surface of the upper cylindrical portion, is substantially circular and this narrows to a point at the base of the indentation. A sampling device is thus automatically directed to the centre of the closure means.

The width, shape and configuration of the slit 35 are important. Prior to insertion into a container the opposing walls of the slit are substantially non-parallel. The wells diverge outwards in the region where the slit and the indentation 37 meet and converge at a point 36 near to the bottom of the closure means. The convergence of the opposing slit walls at point 36 creates a constriction running substantially the whole width of the slit. The slit walls then diverge again such that they are spaced apart again at the bottom of the closure means. This arrangement has the advantage that after insertion into a suitable container, the slit is generally closed but the opposing walls are forced together particularly tightly along a small region 36 extending substantially across the whole width of the slit.

It is advantageous if the sealing ring 38 is located in a similar region along the longitudinal axis of the closure means as the plane 36 where the opposing walls of the slit make contact. In this way, any additional force tending to compress the slit acts on the region where the breadth of the slit is narrowest.

The bottom perimeter of the closure means 33 is radiused rather than chamfered. This has the advantage that, following insertion into a container, there is substantially no crevice or region for fluid to become trapped in. However, the radiused arrangement means that the closure means can be easily located into a container even when it is a tight sliding fit.

It will therefore be appreciated that a closure means according to the present invention is characterised by having a slit that is non-uniform in its dimensions. The slit may be non-uniform in its width or its breadth or both. Typically, the entrance to the slit is located substantially at the bottom of an indentation or depression in the outer, uppermost surface of the closure means. As one moves down the slit travelling away from the entrance, the breadth of the slit reduces when the closure is in its resting configuration. That is to say the slit gets narrower. Having reached a certain, narrow point the breadth of the slit increases again as the slit terminates at the exit on the inner, lowermost in use surface of the closure means. The slit therefore has a waist or pinch point 16, 26, 36 partway along its length.

The width of the slit can also vary, being narrower at the entrance than at exit.

The examples given above have been described with reference to sample tubes. Such tubes can take a variety of forms such as test tubes, vials or multi-well plates. Providing the container in question has a substantially straight-sided wall at its open end or mouth then this type of closure means can be used. This principle can be extended to the manufacture of closures for larger containers such as bottles, kegs or the like of required.

The invention claimed is:

1. A closure configured to fit into the neck or mouth of a container, said closure comprising a plug of resilient material incorporating a slit, defined by a pair of adjacent opposing side walls, which extends entirely through the body of the plug characterised in that, in a resting configuration and prior to insertion of the closure into a container, the breadth of the slit is non-uniform along the length of the slit.

2. A closure as claimed in claim 1 wherein the slit incorporates a constriction running substantially the width of the slit.

3. A closure as claimed in claim 2 wherein the constriction is formed by the opposing side walls of the slit substantially touching across substantially the whole width of the slit.

4. A closure as claimed in claim 1 wherein an upper portion of the plug incorporates a depression which serves to direct a sampling device towards the entrance to the slit.

5. A closure as claimed in claim 4 wherein the depression is substantially conical-shaped.

6. A closure as claimed in claim 4 wherein the depression is formed in the shape of a right circular cone.

7. A closure as claimed in claim 1 wherein the plug of resilient material is formed from a lower cylindrical portion configured to be a tight sliding fit in the neck or mouth of a container and an upper cylindrical portion having a greater diameter than the lower cylindrical portion and configured to overlie the neck or mouth of the container.

8. A closure as claimed in claim 1 wherein the width of the slit varies across the length of the plug.

9. A closure as claimed in claim 8 wherein the width of the slit is narrower at an upper end of the slit than at a lower end of the slit.

10. A closure as claimed in claim 9 wherein the slit extends substantially entirely across the diameter of the plug at the lower end of the slit.

11. A closure as claimed in claim 1 which further comprises a sealing bead extending substantially entirely around the circumference of the resilient plug.

12. A closure as claimed in claim 11 wherein the sealing bead is so sized, shaped and configured as to fit into a corresponding indentation around the inside perimeter of the neck or mouth of a container.

13. A closure as claimed in claim 1 wherein the bottom perimeter of a lower cylindrical portion is radiused or chamfered.

14. A closure as claimed in claim 1 wherein the plug of resilient material is set into a closure body, said closure body being configured to fit into the neck or mouth of a container.

15. A closure configured to fit into the neck or mouth of a container, said closure comprising a plug of resilient material incorporating a slit, defined by a pair of adjacent opposing side walls, which extends entirely through the body of the plug characterised in that the width of the slit as it extends across the plug is non-uniform along the length of the slit.

16. A closure as claimed in claim 15 wherein the slit incorporates a constriction running substantially the width of the slit.

17. A closure as claimed in claim 16 wherein the constriction is formed by the opposing side walls of the slit substantially touching across substantially the whole width of the slit.

18. A closure as claimed in claim 15 wherein an upper portion of the plug incorporates a depression that serves to direct a needle or other sampling device towards the entrance to the slit.

19. A closure as claimed in claim 18 wherein the depression is substantially conical-shaped.

20. A closure as claimed in claim 18 wherein the depression is formed in the shape of a right circular cone.

21. A closure as claimed in claim 15 wherein the plug of resilient material is formed from a lower cylindrical portion configured to be a tight sliding fit in the neck or mouth of a container and an upper cylindrical portion having a greater diameter than the lower cylindrical portion and configured to overlie the neck or mouth of the container.

22. A closure as claimed in claim 15 wherein the width of the slit is narrower at an upper end of the slit than at a lower end of the slit.

23. A closure as claimed in claim 22 wherein the slit extends substantially entirely across the diameter of the plug at the lower end of the slit.

24. A closure as claimed in claim 15 which further comprises a sealing bead extending substantially entirely around the circumference of the resilient plug.

25. A closure as claimed in claim 24 wherein the sealing bead is so sized, shaped and configured as to fit into a corresponding indentation around the inside perimeter of the neck or mouth of a container.

26. A closure as claimed in claim 15 wherein the bottom perimeter of a lower cylindrical portion is radiused or chamfered.

27. A closure as claimed in claim 15 wherein the plug of resilient material is set into a closure body, said closure body being configured to fit into the neck or mouth of a container.

28. The combination comprising a container and the closure claimed in claim 1.

29. The combination comprising a container and the closure as claimed in claim 15.

30. A closure as claimed in claim 5 wherein the depression is formed in the shape of a right circular cone.

31. A closure as claimed in claim 16 wherein an upper portion of the plug incorporates a depression that serves to direct a needle or other sampling device towards the entrance to the slit.

32. A closure as claimed in claim 17 wherein an upper portion of the plug incorporates a depression that serves to direct a needle or other sampling device towards the entrance to the slit.

33. A closure as claimed in claim 19 wherein the depression is formed in the shape of a right circular cone.

34. A closure as claimed in claim 4 wherein the depression is funnel-shaped.

35. A closure as claimed in claim 18 wherein the depression is funnel-shaped.

36. A closure as claimed in claim 31 wherein the depression is funnel-shaped.

37. A closure as claimed in claim 32 wherein the depression is funnel-shaped.

* * * * *